US008738295B2

(12) United States Patent
Baez et al.

(10) Patent No.: US 8,738,295 B2
(45) Date of Patent: May 27, 2014

(54) SHALE ANALYSIS METHODS

(75) Inventors: Luis R. Baez, Houston, TX (US); Douglas N. Valleau, Conroe, TX (US); Paul M. Basinski, Houston, TX (US); Gerald Eric Michael, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 222 days.

(21) Appl. No.: 13/099,894

(22) Filed: May 3, 2011

(65) Prior Publication Data

US 2011/0282584 A1 Nov. 17, 2011

Related U.S. Application Data

(60) Provisional application No. 61/331,574, filed on May 5, 2010.

(51) Int. Cl.

| | |
|---|---|
| ***G01V 1/40*** | (2006.01) |
| ***G01V 9/00*** | (2006.01) |
| ***G01N 15/08*** | (2006.01) |

(52) U.S. Cl.

USPC ..... 702/13; 702/2; 702/5; 702/11

(58) Field of Classification Search

USPC ..... 702/2, 5, 11, 13

See application file for complete search history.

(56) References Cited

U.S. PATENT DOCUMENTS

2008/0157584 A1 7/2008 Kieschnick

OTHER PUBLICATIONS

Lewis, Rick; Ingraham, David; Pearcy, Marc; Williamson, Jeron; Sawyer, Walt; Frantz, Joe, "New Evaluation Techniques for Gas SHale Reservoirs," 2004, Reservoir Symposium 2004, pp. 1-11.*

Nicolas, M.P.B. and Bamburak, J.D. 2009: Geochemistry and mineralogy of Cretaceous shale, Manitoba (parts of NTS 62C F, G, H, J, K, N): preliminary results; in Report of Activities 2009, Manitoba Innovation, Energy and Mines, Manitoba Geological Survey, p. 165-174.*

Irving Langmuir, "The Constitution and Fundamental Properties of Solids and Liquids", Contribution from Research Laboratory of the General Electric Company, Sep. 5, 1916, pp. 2221-2295.

* cited by examiner

*Primary Examiner* — Janet Suglo

(74) *Attorney, Agent, or Firm* — ConocoPhillips Company

(57) ABSTRACT

Methods and systems are provided for rapidly estimating the hydrocarbon production potential of a subsurface hydrocarbon shale prospect or prospects. In short, the methods disclosed herein provide rapid mechanisms to determine sorbed gas storage of a shale reservoir with minimal delay and resource expenditure to aid operators in determining which prospects to exploit.

In certain embodiments, an empirical implemented method for rapidly assessing hydrocarbon content of a shale reservoir comprises extracting one or more shale samples, performing a rock eval pyrolysis on the shale samples to determine certain geochemical properties of the shale, using the geochemical properties to determine a thermal maturity of the shale, determining a Langmuir volume of the shale, generating a adsorption isotherm of the shale, and determining a gas storage capacity of the shale. Advantages of the methods include a more efficient and rapid determination of shale gas storage with a minimal expenditure of resources.

15 Claims, 2 Drawing Sheets

SHALE ANALYSIS METHODS

CROSS-REFERENCE TO RELATED APPLICATIONS

This application is a non-provisional application which claims the benefit of and priority to U.S. Provisional Application Ser. No. 61/331,574 filed May 5, 2010, entitled "Shale Analysis Methods," which is hereby incorporated by reference in its entirety.

FIELD OF THE INVENTION

The present invention relates generally to methods and systems for evaluating hydrocarbon prospects. More particularly, but not by way of limitation, embodiments of the present invention include methods and systems for estimating the hydrocarbon production potential of a subsurface hydrocarbon shale prospect or prospects.

BACKGROUND

Determining the expected hydrocarbon recovery from a shale hydrocarbon prospect is an important role in determining the desirability of completing a well for exploiting the prospect. Various methods have been developed to predict the potential production performance of a hydrocarbon prospect. Generally, it is desired to make this determination in the most cost effective, efficient fashion with a minimum of delay. These factors become especially significant where an operator has a need to simultaneously evaluate dozens or even hundreds of hydrocarbon prospects.

Examples of conventional methods for determining expected hydrocarbon production potential for hydrocarbon prospects include, for example, seismic surveys, well logging techniques, and core sampling. Unfortunately, each of the conventional methods for evaluating expected hydrocarbon recovery from a prospect suffers from one or more significant disadvantages.

Although seismic surveys can reveal a great deal of geological information about a surveyed zone, seismic surveys are highly limited in their ability to estimate hydrocarbon recovery potential, because seismic surveys fail to yield the detailed type of data required for accurate well performance predictions. In addition to this failure of providing accurate estimations of hydrocarbon recovery potential, seismic surveys are costly to perform and require significant resources.

Various well logging tools can also provide a myriad of downhole information related to a prospect, including significant geological information relating to a particular well. Nevertheless, well logging devices traditionally fail to provide adequate data for efficiently estimating a prospect's hydrocarbon production potential. Moreover, logging a well is both costly and time intensive.

Of the conventional methods, core sampling can provide the most detailed information about a prospect's hydrocarbon production potential. Again, however, this conventional method suffers from both high cost and significant time delays. Not only does this method require drilling and extracting a core sample, which is resource and time intensive, this method also requires onerous lab tests to be performed to analyze the core samples.

Accordingly, there is a need in the art for improved methods and devices for quickly and inexpensively evaluating hydrocarbon prospects that address one or more disadvantages of the prior art.

SUMMARY

The present invention relates generally to methods and systems for evaluating hydrocarbon prospects. More particularly, but not by way of limitation, embodiments of the present invention include methods and systems for estimating the hydrocarbon production potential of a subsurface hydrocarbon shale prospect or prospects.

One example of an empirical method for determining an adsorbed gas storage capacity of a shale reservoir comprises the steps of: extracting one or more shale samples from the shale reservoir at a plurality of depths; performing a rock eval pyrolysis on the one or more shale samples to determine a $T_{max}$ of the one or more shale sample, an S1 of the one or more shale samples, and a TOC content of the one or more shale samples, wherein S1 is an amount of free hydrocarbons in the one or more shale samples and wherein TOC is a total organic carbon (TOC) content of the one or more shale samples; determining a thermal maturity of the shale reservoir at each depth, wherein the thermal maturity is characterized as one of immature, oil zone, or gas zone, wherein the thermal maturity is characterized as immature if $T_{max}$ is less than about 435° F., wherein the thermal maturity is characterized as oil zone if $T_{max}$ is from about 435° F. to about 465° F., and wherein the thermal maturity is characterized as a gas zone if $T_{max}$ is more than about 465° F.; determining a Langmuir volume ($G_{sL}$) of the shale reservoir at each depth, wherein the Langmuir volume ($G_{sL}$) is characterized by a first product (a·S1) if the shale reservoir is characterized as oil zone and wherein the Langmuir volume ($G_{sL}$) is characterized by a second product (b·TOC) if the shale reservoir is characterized as immature or gas zone, wherein a is a constant from about 35 to about 38, and wherein b is a constant from about 19 to about 25; generating a synthetic adsorption isotherm, wherein the synthetic adsorption isotherm is a set of sorbed gas storage capacities corresponding to a range of desired pressures, wherein each sorbed gas storage capacity ($G_{cs}$) for a particular pressure (p) is determined according to the relationship, wherein $p_L$ is a Langmuir pressure of the shale reservoir; and outputting the synthetic adsorption isotherm to a user.

Another example of an empirical method for determining an adsorbed gas storage capacity of a shale reservoir comprising the steps of: determining a $T_{max}$ of a shale sample of the shale reservoir; determining a thermal maturity of the shale reservoir, wherein the thermal maturity is characterized as one of immature, oil zone, or gas zone, wherein the thermal maturity is characterized as immature if $T_{max}$ is less than about 435° F., wherein the thermal maturity is characterized as oil zone if $T_{max}$ is from about 435° F. to about 465° F., and wherein the thermal maturity is characterized as a gas zone if $T_{max}$ is more than about 465° F.; determining a Langmuir volume (GsL) of the shale reservoir, wherein the Langmuir volume ($G_{sL}$) is characterized by a first product (a·S1) if the shale reservoir is characterized as oil zone and wherein the Langmuir volume ($G_{sL}$) is characterized by a second product (b·TOC) if the shale reservoir is characterized as immature or gas zone, wherein a is a constant from about 35 to about 38, and wherein b is a constant from about 19 to about 25; and generating a synthetic adsorption isotherm, wherein the synthetic adsorption isotherm is a set of sorbed gas storage capacities corresponding to a range of desired pressures, wherein each sorbed gas storage capacity ($G_{cs}$) for a particular pressure (p) is determined using the Langmuir equation, wherein $p_L$ is a Langmuir pressure of the shale reservoir, $G_{sL}$ in-situ Langmuir storage, and p is a pressure step.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figure 1:
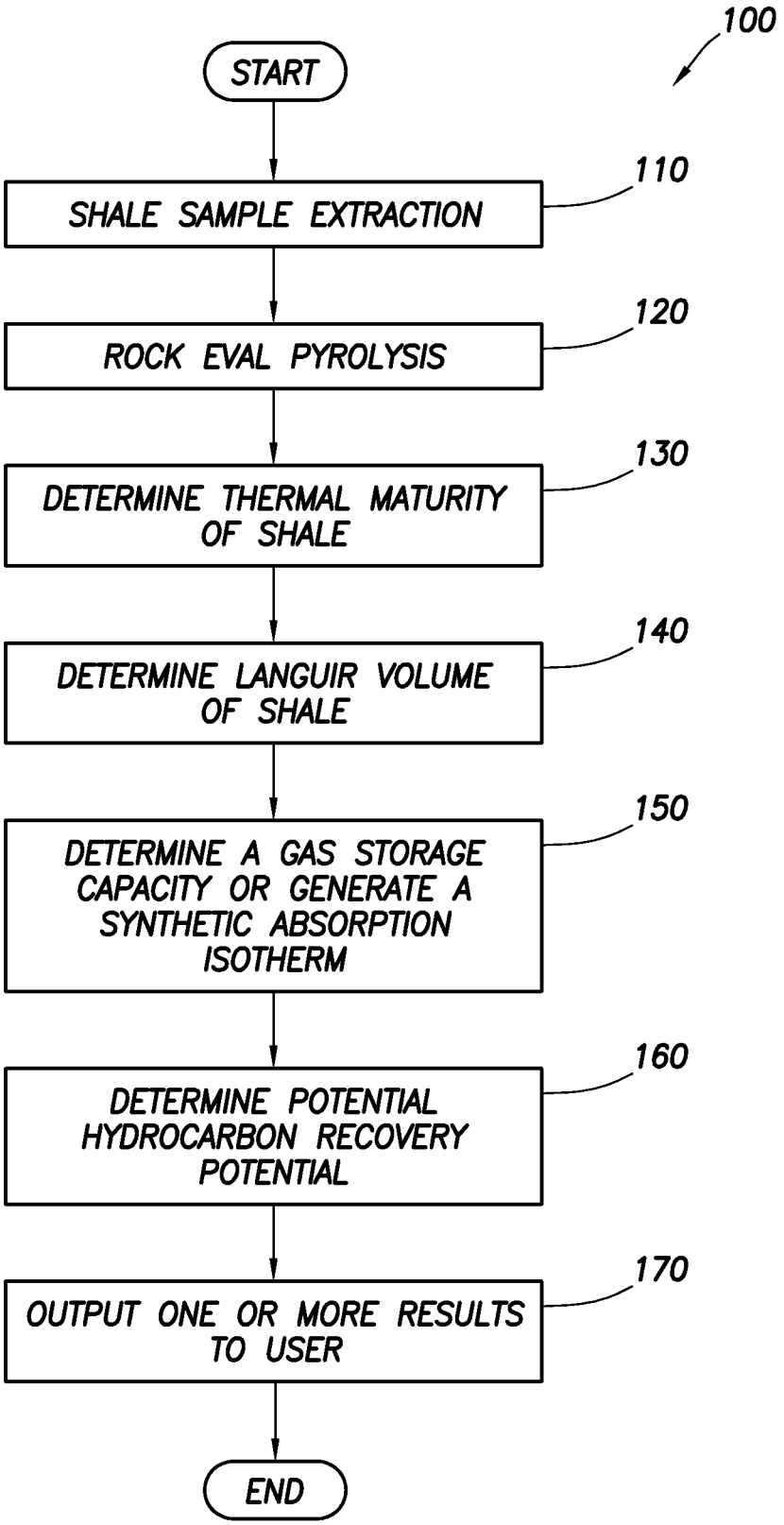
FIG. 1 illustrates a method for estimating an adsorbed gas storage capacity of a shale reservoir in accordance with one embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The present invention relates generally to methods and systems for evaluating hydrocarbon prospects. More particularly, but not by way of limitation, embodiments of the present invention include methods and systems for estimating the hydrocarbon production potential of a subsurface hydrocarbon shale prospect or prospects.

Methods and systems are provided for rapid assessment of hydrocarbon storage of shale prospects. Rapid evaluation of hydrocarbon content of shale prospects aids operators in determining which prospects to exploit. In short, the methods disclosed herein provide rapid mechanisms to determine sorbed gas storage of a shale reservoir with minimal delay and resource expenditure.

In certain embodiments, an empirical implemented method for rapidly assessing hydrocarbon content of a shale reservoir comprises extracting a shale sample, performing a rock eval pyrolysis on the shale sample to determine certain geochemical properties of the shale, using the geochemical properties to determine a thermal maturity of the shale, determining a Langmuir volume of the shale, generating a adsorption isotherm of the shale, and determining a gas storage capacity of the shale. Advantages of the methods herein, include, but are not limited to, a much more efficient and rapid determination of shale gas storage with a minimal expenditure of resources.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the invention.

FIG. 1 illustrates a method for estimating an adsorbed gas storage capacity of a shale reservoir in accordance with one embodiment of the present invention.

Generally, method 100, via steps 110 to 170, allows for the estimation of an amount of sorbed gas storage capacity ($G_{cs}$) of a shale reservoir. Sorbed gas storage capacity ($G_{cs}$) is one significant component needed to determine the total gas content or storage capacity of a shale reservoir. In general, the total gas content ($G_{cs}$) of a shale reservoir is the sum of the sorbed gas content thereof ($G_{cs}$), the free gas content thereof ($G_{cd}$), and the dissolved gas content thereof. The following steps of method 100 focus on estimation of sorbed gas storage capacity ($G_{cs}$), a significant component of the total gas storage capacity ($G_{cs}$) of the shale reservoir.

In step 110, a representative sample is extracted from the shale reservoir. In certain embodiments, multiple samples may be extracted.

In step 120, a rock eval pyrolysis is then performed on the sample to obtain certain geochemical characteristics of the shale. Rock eval pyrolysis is a standard procedure used to identify the type and maturity of organic matter in sediments. In particular, the quantities $T_{max}$, S1, and TOC content of the shale are some of the geochemical properties measured. $T_{max}$ refers to is the temperature at which the maximum release of hydrocarbons from cracking of kerogen occurs during pyrolysis of the shale. S1 refers to the amount of free hydrocarbons (gas and oil) in the sample. TOC content refers to the total organic carbon content of the sample. Although the standard procedure of rock eval pyrolysis is well documented elsewhere, a brief overview of the process is provided here for completeness. TOC content analysis and pyrolysis are two aspects of rock eval pyrolysis that can provide the desired geochemical shale properties.

Total organic carbon (TOC) content is usually measured via a LECO® carbon analyzer system. The quantity of organic material present in sedimentary rocks is measured as the total organic carbon (TOC) content, which here is determined by combustion. In this procedure, carbonates are removed from the rock sample of interest with hydrochloric acid before combustion as these minerals would yield carbon dioxide during combustion. TOC analyses are then run in a LECO® carbon analyzer that combusts a 140 mg sample of powdered rock at 1,300° F. in the presence of a large excess of oxygen. All organic carbon is converted to carbon dioxide that is trapped within the instrument and released into a detector once combustion is complete. The amount of carbon dioxide measured is proportional to the total organic carbon (TOC) content.

Pyrolysis mimics the natural hydrocarbon generation process that occurs over geologic time at much lower temperatures. Roughly 50 to 100 mg of the sample is heated slowly in the absence of oxygen from 300 to 550° C. Exclusion of oxygen ensures that only thermal decomposition reactions occur.

During heating, a first volume of hydrocarbon is released when heated at a temperature of 300° C. for three minutes. These hydrocarbons are analogous to solvent-extractible bitumen. The hydrocarbon volume is monitored by a detector and a peak referred to as S1 is recorded. High S1 values indicate large volumes of bitumen in an active source rock or the presence of migrated hydrocarbons. S1 normally increases with depth.

The temperature is then increased by 25° C. per minute to a maximum temperature of 600° C. A second volume of hydrocarbon begins to emerge above approximately 350° C., and reaches a maximum flux rate somewhere between about 420° C. and about 480° C., and then declines. This second volume of hydrocarbons is referred to as S2 and represents the hydrocarbon volume generated by thermal decomposition of kerogen. The S2 peak is typically the most important indicator of the present-day ability of the kerogen to generate hydrocarbons. The temperature at which the S2 peak occurs is referred to as $T_{max}$. $T_{max}$ may not be reliable when S2 is less than approximately 0.2 mg/g.

Carbon dioxide ($CO_2$) is also released from the kerogen during pyrolysis. It is recorded by the $CO_2$ detector as a peak referred to as S3 and is detected in the temperature range of about 300° C. to about 390° C. The amount of carbon dioxide released is generally believed to be related to the oxygen content of the kerogen. High oxygen content is considered a negative indicator of source rock potential.

In summary, the four parameters obtained from pyrolysis are as follows:

S1 bitumen content of the source rock, mg/g of rock

S2 future hydrocarbon generating potential of the source rock, mg HC/g of rock

S3 $CO_2$ generated by thermal decomposition, mg/g of rock $T_{max}$ the temperature at which maximum hydrocarbon generation occurs, ° C.

These four parameters are traditionally used to determine the thermal maturity and source rock characteristics of the organic material. Source rock types are often characterized as followed as one of three types of source rocks as follows:

1. Effective source rock: any sedimentary rock that has already generated and expelled hydrocarbons.
2. Possible source rock: any sedimentary rock whose source potential has not been evaluated but may have generated and expelled hydrocarbons.
3. Potential source rock: any immature sedimentary rock known to be capable of generating and expelling hydrocarbons if the level of thermal maturity were greater.

Accordingly, the determination of TOC content and S1, which in certain embodiments may be obtained through a standard rock eval pyrolysis test, concludes step 120. Next, in step 130, the thermal maturity of the shale may be determined. Thermal maturation can be related to $T_{max}$, which often increases with depth. $T_{max}$ is also dependent on kerogen type, which can cause $T_{max}$ values to not increase with depth as expected. Therefore, isolated $T_{max}$ values are not considered representative. The thermal maturity is classified as follows:

Immature: Less than about 435° C.

Oil Zone Greater than about 435° C. and less than about 465°

Gas Zone Greater than about 465° C.

Both the oil zone and the gas zone are considered potential source rock for hydrocarbons whereas an immature zone is usually considered to generate insufficient hydrocarbons for economic viability. In this way, the measured $T_{max}$ may be used to characterize the thermal maturity of shale as immature, oil zone, or gas zone. In certain embodiments, $T_{max}$ may be obtained by other means known in the art, including, but not limited to, vitrinite reflectance and TAI index. Where $T_{max}$ is obtained by a method other than by step 120, it is recognized that step 110 and/or step 120 may be optional.

In step 140, the Langmuir volume ($G_{sL}$) of the shale is determined The Langmuir volume ($G_{sL}$) and its significance is described in detail in Langmuir, Irving, *The Constitution and Fundamental Properties of Solids and Liquids, Part I. Solids,* 38 J. Am. Chem. Soc. 2221-95 (1916). The Langmuir volume ($G_{sL}$) is particularly useful, because it is related to the sorbed gas storage capacity in a shale gas reservoir as will be further described below with respect to step 150.

More specifically, determination of the Langmuir volume ($G_{sL}$) depends on the thermal maturity of the shale, and more particularly, on whether the thermal maturity of the shale is characterized as immature, oil zone, or gas zone.

Where the shale is characterized as oil zone, the Langmuir volume ($G_{sL}$) may be characterized by a first product (a·S1). Where the shale is characterized as immature or gas zone, the Langmuir volume (GsL) may be characterized by second product (b·TOC). In certain embodiments, the constant "a" is a constant from about 35 to about 38, and the constant "b" is a constant from about 19 to about 25. In other embodiments, the constant "a" is about 36.3, and the constant "b" is about 21.8.

In step 150, a sorbed gas capacity ($G_{cs}$) or capacities of the shale may be determined that corresponds to one or more pressures. The sorbed gas storage capacity ($G_{cs}$) for a particular pressure (p) is determined according to the relationship, $$G_{cs} = G_{sL}\left(\frac{p}{p + p_L}\right),$$

wherein $p_L$ is a Langmuir pressure of the shale. Again, $G_{sL}$ is the Langmuir volume determined above in step 140.

The Langmuir pressure ($p_L$) may be determined as part of step 150 to determine the sorbed gas capacity ($G_{cs}$) of the shale. In certain embodiments, the Langmuir pressure may be characterized by the quantity ($c \cdot T_{max} - d$) if the shale reservoir is characterized as immature or gas zone. Where the shale reservoir is characterized as oil zone, the Langmuir pressure may be characterized by the quantity ($e \cdot T_{max} - f$).

In certain embodiments, the constant c is constant from about 4.9 to about 5.4, and the constant d is a constant from about 1,697 to about 1,876. In certain embodiments, e is a constant from about 106 to about 117 and wherein f is a constant from about 45,422 to about 50,204. In other embodiments, the constant c is about 5.1, the constant d is about 1,786, the constant e is about 111.8, and the constant f is about 47,813.

The sorbed gas capacities calculated as part of step 150 may also be evaluated for a range of pressures to generate a set of sorbed gas storage capacities as a function of pressure. These calculated sorbed gas storage capacities may be integrated with reservoir pressure to provide the total sorbed gas storage of the shale reservoir as desired.

Upon determination of the sorbed gas storage capacity, the total gas storage capacity ($G_{cs}$) may be determined in step 160. As described above, the total gas capacity ($G_{cs}$) is the sum of the sorbed gas capacity ($G_{cs}$), the free gas capacity ($G_{cf}$), and the dissolved gas capacity ($G_{cd}$).

Again the sorbed gas storage capacity ($G_{cs}$) is a significant component of the total gas storage. The dissolved gas capacity is typically rather small and in certain optional embodiments, is sufficiently negligible that it is ignored. The free gas capacity ($G_{cf}$) may be determined according to the relationship $$\rho = (1-\phi)\rho_{ma} + \phi \cdot \rho_f$$

where:

$\phi$ porosity, fraction of bulk volume $\rho$ bulk density, g/cm$^3$ $\rho_{ma}$ matrix (grain) density, g/cm$^3$ $\rho_f$ density of fluid within the porosity, g/cm$^3$ In step 170, one or more of the above parameters is provided to a user. Examples of suitable parameters that may be outputted to a user include, but are not limited to, the thermal maturity determined as part of step 130, one or more of the Langmuir volumes determined as part of step 140, one or more of the gas storage capacities determined as part of step 150, the total gas storage capacity determined as part of step 160, or any combination thereof.

Figure 2:
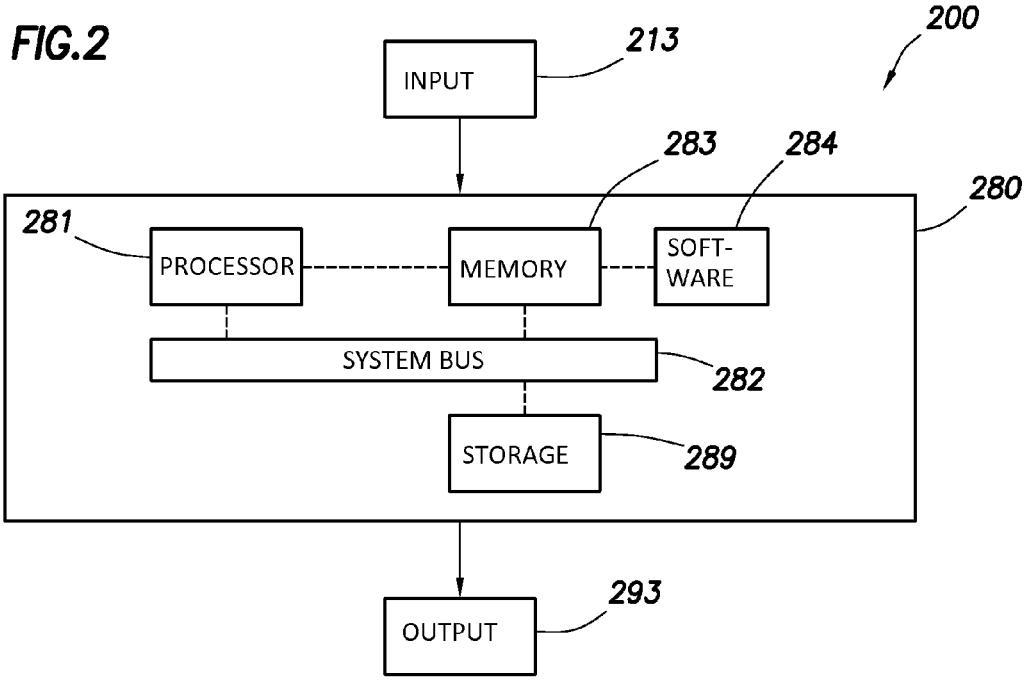
FIG. 2 illustrates a computer system for calculating adsorbed gas storage capacity of a shale reservoir in a subterranean formation.

FIG. 2 illustrates an empirical method for estimating an adsorbed gas storage capacity of a shale reservoir in a subterranean formation.

One or more methods of the present invention may be implemented via an information handling system. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU or processor) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

As an example of one implementation of an information handling system for use in combination with the present invention, user input is communicated from a user input device or devices 213 to information handling system 280, which is comprised of processor or CPU 281, system bus 282, memory 283, software 284, and storage 289. Information handling system 280 may be used to implement any of the determination steps described above. As described above, information handling system 280 may output one or more of the determined parameters to output device 293, which may be any output device known in the art, including a display or printer output.

Figure 3:
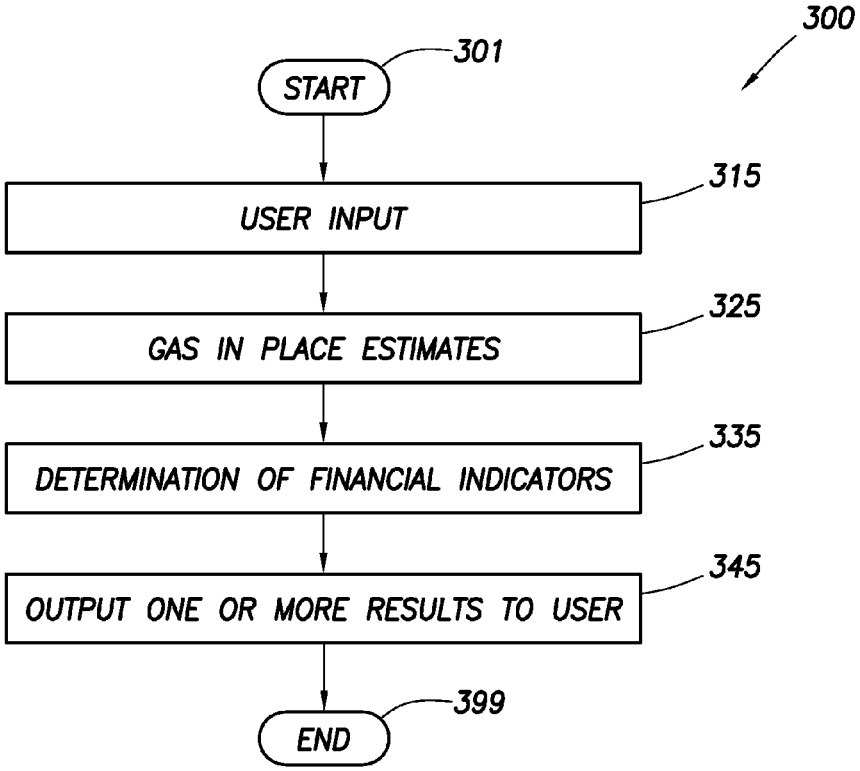
FIG. 3 illustrates a method for assessing certain financial indicators relating to a shale prospect of interest in accordance with one embodiment of the present invention.

FIG. 3 illustrates a method 300 for assessing certain financial indicators relating to a shale prospect of interest in accordance with one embodiment of the present invention.

In step 315, the user inputs parameters which may be used to determine gas in place estimates in step 325. These steps may use any of the steps and features described above as to method 100 to accomplish these objectives. Upon determining the gas in place, either on a storage capacity basis, any number of financial indicators may be determined relating to the economic desirability of exploiting a shale prospect. Examples of suitable financial indicators include, but are not limited to, a project resource indicator. A project resource indicator may comprise the product of the original gas in place and the expected project recovery efficiency. The project resource indicator may be further refined by further taking into account the chance of success of a contemplated project. Under this refined approach, the project resource indicator comprises the product of the original gas in place, the expected project recovery efficiency, and the chance of success.

To facilitate a better understanding of the present invention, the following examples of certain embodiments are given. In no way should the following examples be read to limit, or define, the scope of the invention.

It is explicitly recognized that any of the elements and features of each of the devices described herein are capable of use with any of the other devices described herein with no limitation. Furthermore, it is explicitly recognized that the steps of the methods herein may be performed in any order except unless explicitly stated otherwise or inherently required otherwise by the particular method.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations and equivalents are considered within the scope and spirit of the present invention.

What is claimed is:

1. An empirical method for determining an adsorbed gas storage capacity of a shale reservoir comprising the steps of:

extracting one or more shale samples from the shale reservoir at a plurality of depths;

performing a rock eval pyrolysis on the one or more shale samples to determine a $T_{max}$ of the one or more shale sample, an S1 of the one or more shale samples, and a TOC content of the one or more shale samples, wherein S1 is an amount of free hydrocarbons in the one or more shale samples and wherein TOC is a total organic carbon (TOC) content of the one or more shale samples;

empirically determining, based on the rock eval pyrolysis, a thermal maturity of the shale reservoir at each depth, wherein the thermal maturity is characterized as one of immature, oil zone, or gas zone, wherein the thermal maturity is characterized as immature if $T_{max}$ is less than about 435° C., wherein the thermal maturity is characterized as oil zone if $T_{max}$ is from about 435° C. to about 465°, and wherein the thermal maturity is characterized as a gas zone if $T_{max}$ is more than about 465° C.;

empirically determining, based on the thermal maturity determination, a Langmuir volume ($G_{sL}$) of the shale reservoir at each depth, wherein the Langmuir volume ($G_{sL}$) is characterized by a first product (a·S1) if the shale reservoir is characterized as oil zone and wherein the Langmuir volume ($G_{sL}$) is characterized by a second product (b·TOC) if the shale reservoir is characterized as immature or gas zone, wherein a is a constant from about 35 to about 38, and wherein b is a constant from about 19 to about 25;

generating, via a computing processor, a synthetic adsorption isotherm, wherein the synthetic adsorption isotherm is a set of sorbed gas storage capacities corresponding to a range of desired pressures, wherein each sorbed gas storage capacity ($G_{cs}$) for a particular pressure (p) is determined according to the relationship, $$G_{cs} = G_{sL}\left(\frac{p}{p + p_L}\right),$$

wherein $p_L$ is a Langmuir pressure of the shale reservoir; and providing an output of the synthetic adsorption isotherm to a user.

2. The method of claim 1 further comprising determining a Langmuir gas storage capacity ($L_v$) at each depth wherein the Langmuir gas storage capacity ($L_v$) is characterized by a product (g·TOC) if the shale reservoir is characterized as gas zone or immature and wherein the Langmuir gas storage capacity ($L_v$) is characterized by a product (h·S1) if the shale reservoir is characterized as oil zone, wherein the constant g is a constant from about 21 to about 23 and wherein the constant h is a constant from about 35 to 38.

3. The method of claim 2 wherein the constant g is about 21.8 and wherein the constant h is about 36.3.

4. The method of claim 1 further comprising determining a total sorbed gas storage capacity of the shale reservoir.

5. The method of claim 4 wherein the total gas storage capacity ($G_{ct}$) comprises the sum of the sorbed gas storage ($G_{cs}$) and a free gas capacity ($G_{cf}$) of the shale reservoir.

6. The method of claim 5 wherein the free gas capacity ($G_{cf}$) is characterized by the relationship $\rho=(1-\phi)\rho_{ma}+\phi\cdot\rho_f$, wherein $\phi$ is a porosity as a fraction of bulk volume, $\rho$ is a bulk density, $\rho_{ma}$ is a matrix (grain) density, $\rho_f$ is a density of fluid within the porosity.

7. The method of claim 5 wherein the total gas storage capacity ($G_{ct}$) comprises the sum of the sorbed gas storage ($G_{cs}$), a free gas capacity ($G_{cf}$) of the shale reservoir, and a dissolved gas capacity ($G_{cd}$) of the shale reservoir.

8. A method claim 5 further comprising:

determining an original gas in place of the shale reservoir; determining an expected project recovery efficiency of the shale reservoir; determining a project resource indicator that comprises a product of the original gas in place and the expected project recovery efficiency;

outputting the project resource indicator to the user;

wherein $T_{max}$ is determined by a rock eval pyrolysis test; and wherein the Langmuir pressure is characterized by the quantity (c·Tmax−d) if the shale reservoir is characterized as immature or gas zone, wherein c is a constant from about 4.9 to about 5.4 and wherein d is a constant from about 1,697 to about 1,876 and wherein the Langmuir pressure is characterized by the quantity (e·$T_{max}$−f) if the shale reservoir is characterized as oil zone, wherein e is a constant from about 106 to about 117 and wherein f is a constant from about 45,422 to about 50,204.

9. The method of claim 4 further comprising the steps of:

determining an original gas in place of the shale reservoir;

determining an expected project recovery efficiency of the shale reservoir;

determining a project resource indicator that comprises a product of the original gas in place and the expected project recovery efficiency; and outputting the project resource indicator to the user.

10. The method of claim 4 wherein the shale reservoir is a marine-based shale.

11. The method of claim 1 wherein the Langmuir pressure is characterized by the quantity (c·$T_{max}$−d) if the shale reservoir is characterized as immature or gas zone, wherein c is a constant from about 4.9 to about 5.4 and wherein d is a constant from about 1,697 to about 1,876 and wherein the Langmuir pressure is characterized by the quantity (e·$T_{max}$−f) if the shale reservoir is characterized as oil zone, wherein e is a constant from about 106 to about 117 and wherein f is a constant from about 45,422 to about 50,204.

12. The method of claim 11 wherein c is about 5.1 and wherein d is about 1,786, and wherein e is about 111.8 and wherein f is about 47,813.

13. The method of claim 1 wherein a is about 36.3 and wherein b is about 21.8.

14. The method of claim 1 wherein the step of outputting comprises displaying output on a display or printing hard-copy output.

15. An empirical method for determining an adsorbed gas storage capacity of a shale reservoir comprising the steps of:

determining a $T_{max}$ of a shale sample of the shale reservoir;

determining a thermal maturity of the shale reservoir, wherein the thermal maturity is characterized as one of immature, oil zone, or gas zone, wherein the thermal maturity is characterized as immature if $T_{max}$ is less than about 435° C., wherein the thermal maturity is characterized as oil zone if $T_{max}$ is from about 435° C. to about 465° C., and wherein the thermal maturity is characterized as a gas zone if $T_{max}$ is more than about 465° C.;

determining a Langmuir volume ($G_{sL}$) of the shale reservoir, wherein the Langmuir volume ($G_{sL}$) is characterized by a first product (a·S1) if the shale reservoir is characterized as oil zone and wherein the Langmuir volume ($G_{sL}$) is characterized by a second product (b·TOC) if the shale reservoir is characterized as immature or gas zone, wherein a is a constant from about 35 to about 38, and wherein b is a constant from about 19 to about 25; and generating, via a computer processor, a synthetic adsorption isotherm, wherein the synthetic adsorption isotherm is a set of sorbed gas storage capacities corresponding to a range of desired pressures, wherein each sorbed gas storage capacity ($G_{cs}$) for a particular pressure (p) is determined using the Langmuir equation, $$G_{cs} = G_{sL}\left(\frac{p}{p + p_L}\right),$$

wherein $p_L$ is a Langmuir pressure of the shale reservoir, $G_{sL}$ in-situ Langmuir storage, and p is a pressure step.

* * * * *